US008828195B2

(12) United States Patent
Moghbeli

(10) Patent No.: US 8,828,195 B2
(45) Date of Patent: Sep. 9, 2014

(54) MULTIPURPOSE SEGMENTED SACRIFICIAL ANODE

(76) Inventor: Omidreza Moghbeli, Rancho Cucamonga, CA (US)

( * ) Notice: Subject to any disclaimer, the term of this patent is extended or adjusted under 35 U.S.C. 154(b) by 556 days.

(21) Appl. No.: 13/191,777

(22) Filed: Jul. 27, 2011

(65) Prior Publication Data

US 2012/0031750 A1 Feb. 9, 2012

Related U.S. Application Data

(60) Provisional application No. 61/370,735, filed on Aug. 4, 2010.

(51) Int. Cl.

| | |
|---|---|
| ***C23F 13/00*** | (2006.01) |
| ***C23F 13/16*** | (2006.01) |
| ***C23F 13/14*** | (2006.01) |
| ***C23F 13/20*** | (2006.01) |

(52) U.S. Cl.

CPC ..... *C23F 13/20* (2013.01); *C23F 13/16* (2013.01); *C23F 2213/32* (2013.01); *C23F 13/14* (2013.01); *C23F 2213/31* (2013.01)

USPC ..... 204/196.31; 204/196.3; 204/196.01; 204/196.36; 204/196.37

(58) Field of Classification Search

CPC ..... C23F 13/00; C23F 13/02; C23F 13/08; C23F 13/16; C23F 13/20; C04B 2111/265

USPC ..... 204/196.01, 196.17, 196.3, 196.37, 204/196.08, 196.31, 196.36; 205/724, 735, 205/740

See application file for complete search history.

(56) References Cited

U.S. PATENT DOCUMENTS

| | | | | | |
|---|---|---|---|---|---|
| 1,785,587 | A | * | 12/1930 | Kuhlmann | 403/265 |
| 2,609,340 | A | * | 9/1952 | McMahon et al. | 204/196.18 |
| 2,947,680 | A | * | 8/1960 | Preiser | 204/196.18 |
| 3,612,586 | A | * | 10/1971 | Stieber et al. | 403/296 |
| 4,544,465 | A | * | 10/1985 | Marsh | 205/731 |
| 4,604,178 | A | * | 8/1986 | Fiegener et al. | 204/288.5 |
| 5,885,427 | A | * | 3/1999 | Pickering et al. | 204/293 |

FOREIGN PATENT DOCUMENTS

| | | | | | |
|---|---|---|---|---|---|
| JP | 2008097922 | A | * | 4/2008 | 156/379.7 |

* cited by examiner

*Primary Examiner* — Luan Van
*Assistant Examiner* — Alexander W Keeling
(74) *Attorney, Agent, or Firm* — Kenneth L. Green

(57) ABSTRACT

A Segmented Sacrificial Anode Assembly (SSAA) includes anode segments made from an anodic material containing an electrically conductive core with electrically conductive threaded female connectors at each end, Glass Reinforced Epoxy (GRE) isolators, and male threaded connectors. A number of the anode segments are connected by short male threaded connectors. A long male connector reaching through the isolator is used when connecting the SSAAs to a standing structure and an electrical cable is used to connect the SSAAs to a buried structure. An electrical lead is attached to a threaded post using pin brazing or Cadweld® and the threaded post is threaded into a recessed end threaded female connector of the SSAA. The recess is filled with two part epoxy. The anode segments may be selected from long, medium, and short anode segments to scale the SSAA for any given application.

21 Claims, 7 Drawing Sheets

MULTIPURPOSE SEGMENTED SACRIFICIAL ANODE

The present application claims the priority of U.S. Provisional Patent Application Ser. No. 61/370,735 filed Aug. 4, 2010, which application is incorporated in its entirety herein by reference.

BACKGROUND OF THE INVENTION

The present invention relates to sacrificial anodes and in particular relates to segmented sacrificial anode assemblies.

Anodes are commonly used to protect metal structure from corrosion. Known sacrificial cathodic protection anodes are selected from existing models for each application and a large inventory is required to meet customer needs. In many applications the anodes are large and difficult to handle. Further, designers of cathodic protection are often limited to a small variety of existing shapes and weights not permitting the selection of an optimal amount of cathodic material and surface area of the cathodic material. A solution is needed to reduce inventory requirements, facilitate varying designs, and make material handling easier.

BRIEF SUMMARY OF THE INVENTION

The present invention addresses the above and other needs by providing a Segmented Sacrificial Anode Assembly (SSAA) includes anode segments made from an anodic material containing an electrically conductive core with electrically conductive threaded female connectors at each end, Glass Reinforced Epoxy (GRE) isolators, and male threaded connectors. A number of the anode segments are connected by short male threaded connectors. A long male connector reaching through the isolator is used when connecting the SSAAs to a standing structure and an electrical cable is used to connect the SSAAs to a buried structure. An electrical lead is attached to a threaded post using pin brazing or CADWELL® and the threaded post is threaded into a recessed end threaded female connector of the SSAA. The recess is filled with two part epoxy. The anode segments may be selected from long, medium, and short anode segments to scale the SSAA for any given application.

In accordance with one aspect of the invention, there are provided anode segments for constructing an SSAA allowing providing reduced inventory, simplified design/scalability, and simplified delivery/installation. A reduced inventory is possible because a user no longer needs to buy hundreds of different types of anodes for different applications leading to a complicated inventory. The user can meet all their needs with the use of these three anode assemblies allowing them to have a simplified inventory. A simplified design/scalability is possible because a user no longer needs to design and purchase anodes that are larger than what they require for their needs because they can now use the same anode assembly using three different anode segments to build the specific anode size needed for their specific need, location and purpose. A simplified delivery/installation is possible because a user no longer needs to handle larger containers and heavy anodes when they require the use of large and heavy anodes. The user may purchase the anode segments and transport them in easy to handle packages which are then assembled on site. This decreases the danger involved in rugged terrain transportation and reduces the chance of fracture and damage of long anodes

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figures 1A, 1B, 1C:
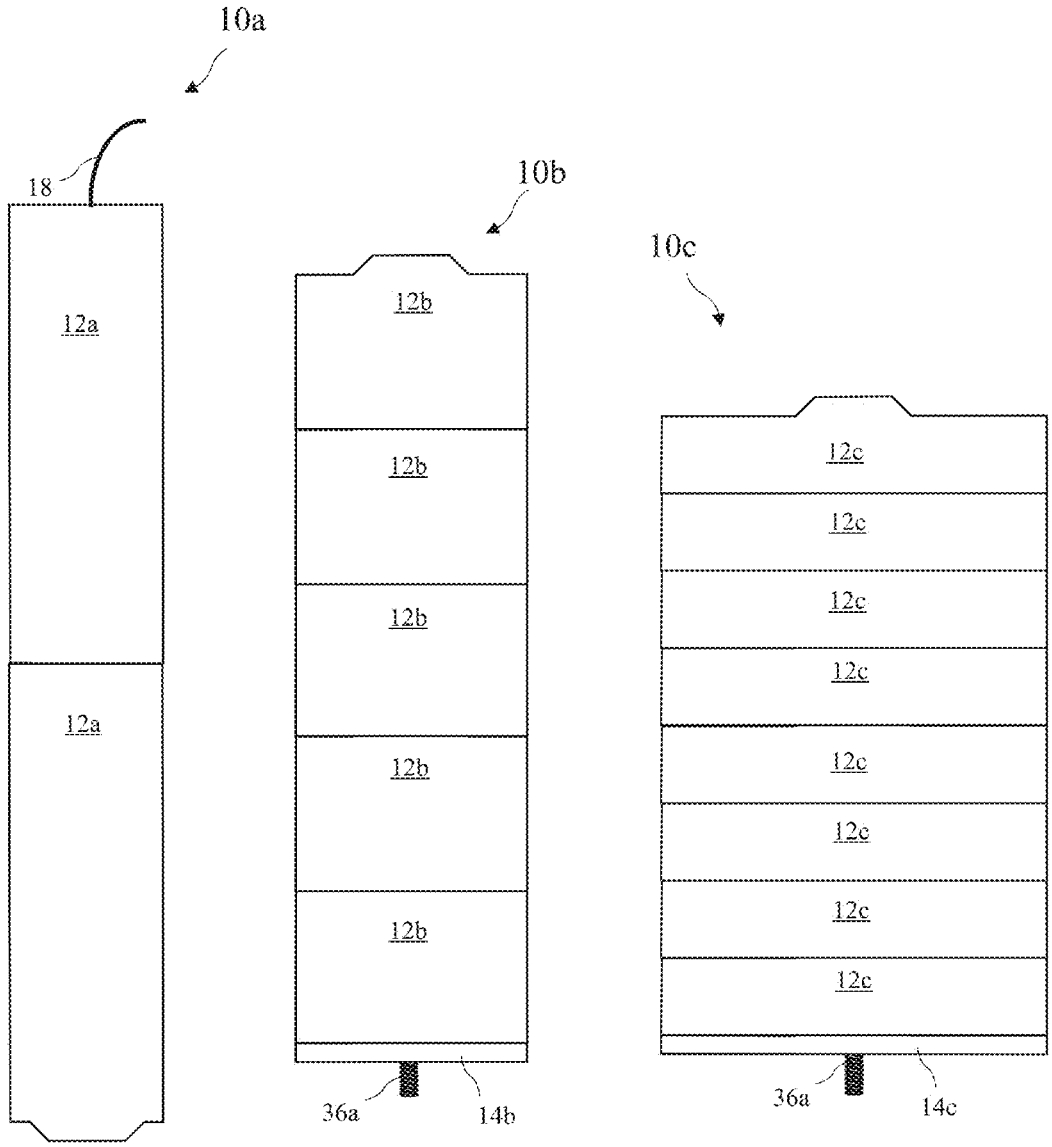
FIG. 1A shows a Segmented Sacrificial Anode Assembly (SSAA) assembled from long anode segments according to the present invention.
FIG. 1B shows an SSAA assembled from medium anode segments according to the present invention.
FIG. 1C shows an SSAA assembled from short anode segments according to the present invention.

A Segmented Sacrificial Anode Assembly (SSAA) 10*a* assembled from long anode segments 12*a* is shown in FIG. 1A, an SSAA 10*b* assembled from medium anode segments 12*a* is shown in FIG. 1B, and an SSAA 10*c* assembled from short anode segments 12*c* is shown in FIG. 1C. The SSAA 10*a* is shown with an electrical lead 18 extending from the top of the SSAA 10*a*. The lead 18 is electrically connected to an electrically conductive core 32 (see FIG. 12) running the length of the anode segment 12*a*. Such lead 18 may be connected to a buried structure to reduce or prevent corrosion. The SSAAs 10*b* and 10*c* are shown including isolators 14*b* and 14*c* and male connectors 36*a* and 36*b* respectively. The isolators 14*b* and 14*c* reside between the SSAA and a standing structure being protected from corrosion. The long male connector 36*b* (see FIG. 13B) extends through the isolator 14*b* and 14*c* and is electrically connected to the electrically conductive core 32 (see FIG. 12) running the length of each anode segment 12*a*, 12*b* and 12*c*. The isolators 14*a*, 14*b*, and 14*c* are preferably made from an electrical insulating material and more preferably from Glass Reinforced Epoxy (GRE). In appropriate applications, the SSAA 10*a* may be fitted with an isolator and male connector to use with free standing structures and the SSAAs 10*b* and 10*c* may be used with leads 18 to use with buried structures.

Figure 2:
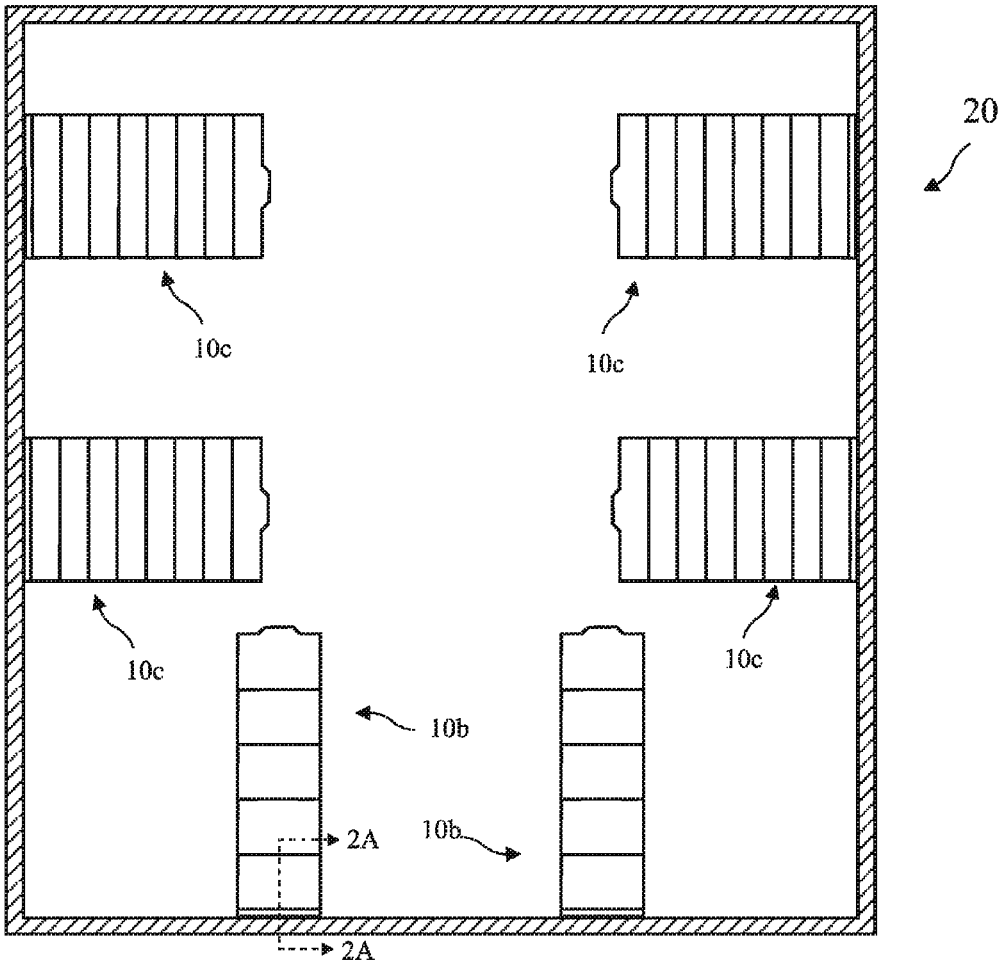
FIG. 2 shows an array of SSAAs inside a tank according to the present invention.
Figure 2A:
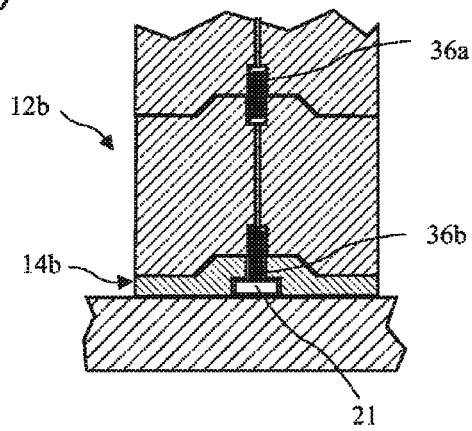
FIG. 2A shows cross-sectional view of a portion of an SSAA inside the tank taken along line 2A-2A of FIG. 2 according to the present invention.

An array of SSAAs 10*b* are shown inside a tank 20 in FIG. 2 and a cross-sectional view of a portion of the SSAA 10*b* inside the tank 20 taken along line 2A-2A of FIG. 2 is shown in FIG. 2A. The SSAA assemblies 10*b* may be attached to the floor, walls, or ceiling of the tank, and SSAA assemblies 10*a* and 10*c* may be used in tanks or other protected structures when the SSAA assemblies 10*b* and 10*c* are better suited to the shape of the structure. The SSAAs 10*b* and 10*c* are electrically and mechanically connected to the tank 20 by a mount 23 comprising a long male connectors 36*b* (see FIG. 13B) and a nut 21, the connector 36*b* including male threads which reach through the isolators 14*b* and 14*c* and into nuts 21 attached to inside walls of the tank 20. The nuts 21 may be any fastener with female threads for the male connector 36*b* to thread into. The consecutive anode segments 12*b* and 12*c* are electrically and mechanically connected by short male connectors 36*a* (see FIG. 13A).

Figure 3:
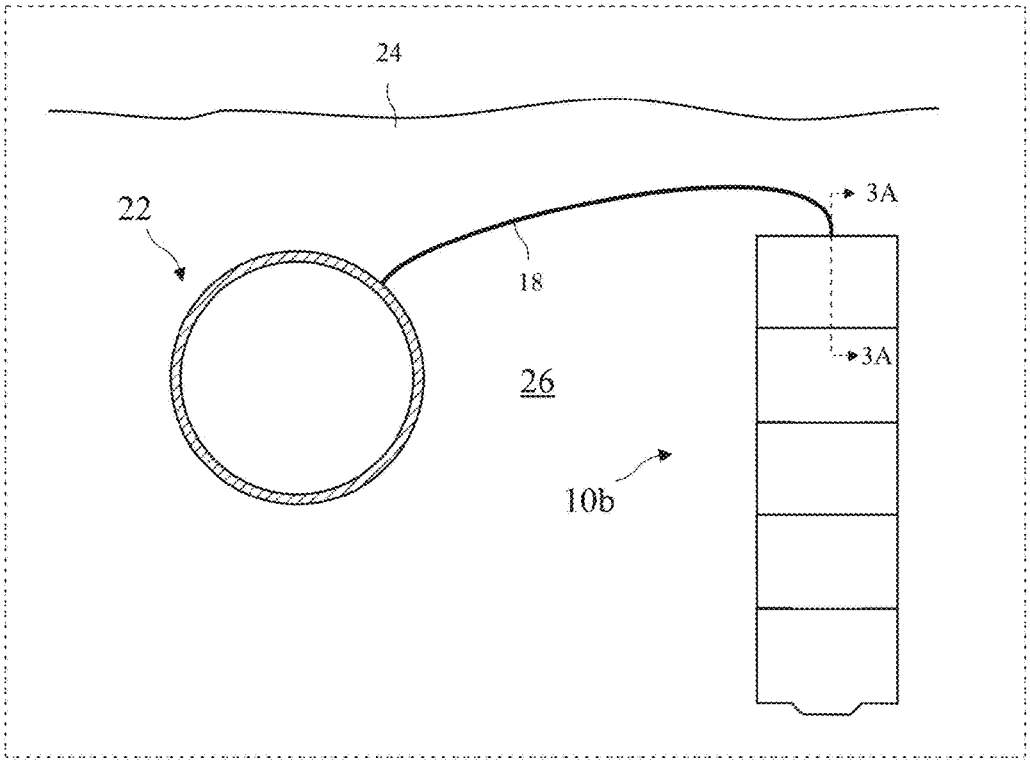
FIG. 3 shows an SSAA protecting a buried structure according to the present invention.
Figure 3A:
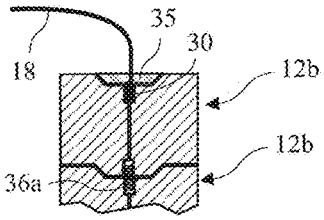
FIG. 3A shows cross-sectional view of a portion of a buried SSAA according to the present invention, taken along line 3A-3A of FIG. 3.
Figure 3B:
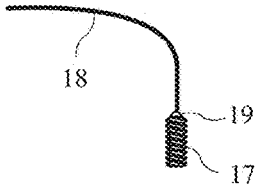
FIG. 3B shows an electrical lead attached to a threaded post for electrically connecting to the anode segment according to the present invention.

An SSAA 10*b* protecting a buried structure 22, for example a buried pipeline, is shown in FIG. 3, a cross-sectional view of a portion of a buried SSAA 10*b* taken along line 3A-3A of FIG. 3 is shown in FIG. 3A, and the electrical lead 18 attached to a threaded male post 17 for electrically connecting to the anode segments 12*a*, 12*b*, and 12*c* according to the present invention. The lead 18 electrically connects the SSAA 10*b* to the buried structure 22 to protect the buried structure 22 from corrosion. A recess in the top of the SSAA 10*b* is filled with two part epoxy 35 and the lead 18 is electrically connected to a female connector 30 residing in the top anode segment 12*b*. The electrical connection is preferably through pin brazing 19 or CADWELL® of the lead 18 to the threaded post 17, and threading the threaded post 17 into the female connector 30, followed by filling the remaining recess in the anode segment with a two part epoxy or the like. Consecutive anode segments 12*b* are electrically and mechanically connected by the short male connector 36*a* (see FIG. 13A).

Figure 4:
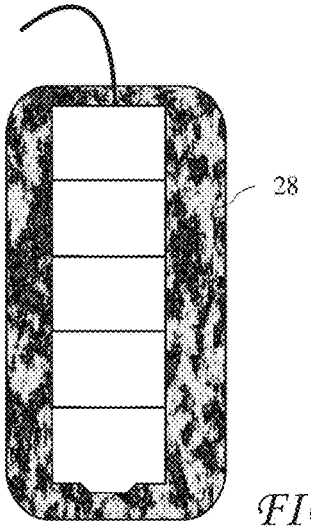
FIG. 4 shows the SSAA packaged inside backfill material for burying according to the present invention.

The SSAA 10*b* assembly is shown packaged inside backfill material 28 for burying in FIG. 4. Soil often includes varying material having varying chemical properties. By burying the SSAA inside pre-packed backfill material providing longer life for the SSAA.

Figure 5:
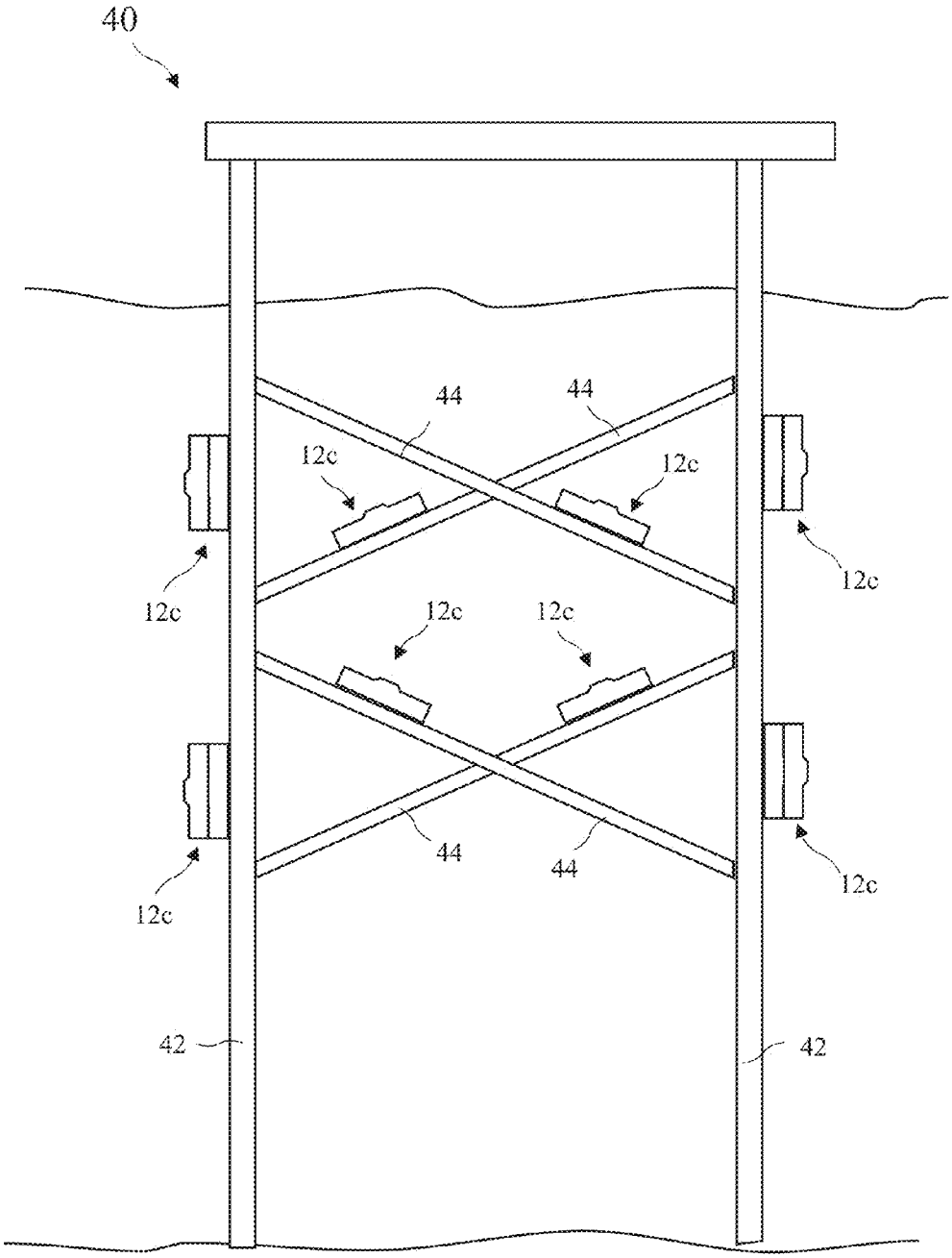
FIG. 5 shows an SSAA protecting an under-water structure according to the present invention.

SSAAs protecting an under-water structure 40 is shown in FIG. 5. One or more SSAAs may be attached to vertical members 42 and/or diagonal (or horizontal) members 44. Where space is limited, a single anode segment 12*c* may be attached, and where more space is available, SSAAs comprising multiple anode segments 12*c* may be attached. The SSAAs are connected to the under-water structure 40 in the same manner as to the tank 20 (see FIGS. 2 and 2A).

Figure 6B:
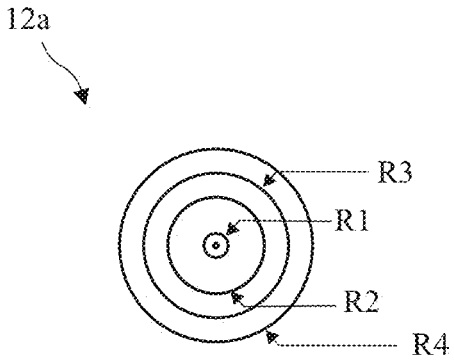
FIG. 6B shows a top view of the long anode segment according to the present invention.
Figure 6A:
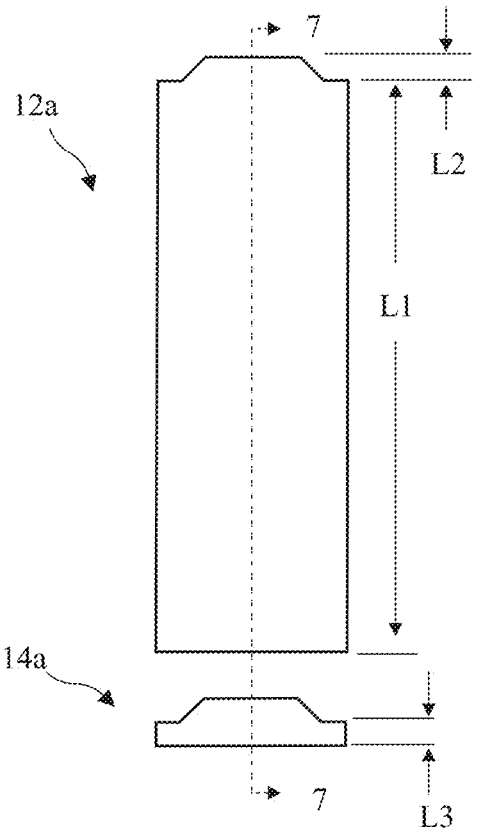
FIG. 6A shows a side view of a long anode segment according to the present invention.
Figure 7:
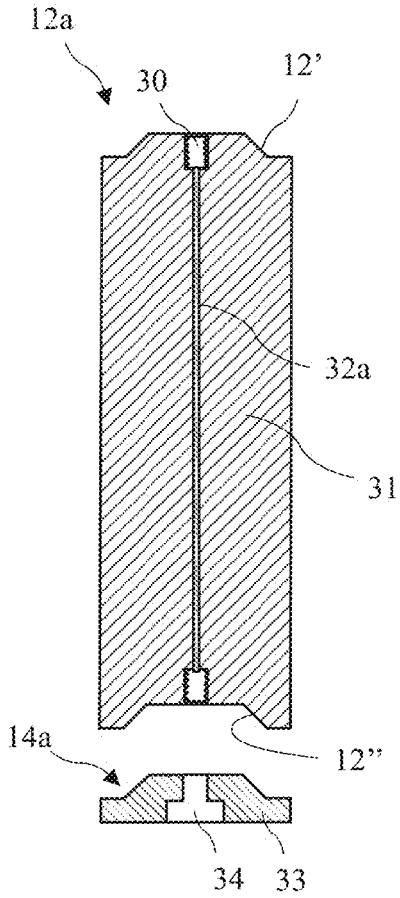
FIG. 7 shows a cross-sectional view of the long anode segment according to the present invention, taken along line 7-7 of FIG. 6A.

Side views of a long anode segment 12*a* and isolator 14*a* are shown in FIG. 6A, a top view of the views of the long anode segment 12*a* is shown in FIG. 6B, and a cross-sectional view of the long anode segment 12*a* and isolator 14*a* taken along line 7-7 of FIG. 6A are shown in FIG. 7. The long anode segment 12*a* comprises a sacrificial material 31 around the electrically conducting core 32*a*. Female connectors 30 are electrically connected to opposite ends of the core 32*a* and includes exposed female threads. The long anode segment 12*a* is cylindrically shaped and has a first conically stepped end 12' and second conically stepped 12". The first conically stepped end 12' includes a convex frustoconical shaped protrusion and the second conically stepped end 12" includes a concave frustoconical shaped intrusion. The ends 12' and 12" preferably have cooperating shapes providing intimate contact between corresponding ends 12' and 12" facilitating joining consecutive anode segments to form the SSAA. The isolator 14*a* defines a stepped cylindrical through passage 34 for the long male connector 36*b* (see FIG. 13B) and is preferably made from GRE.

The sacrificial material 31 is preferably selected from magnesium (high potential, per ASTM B843 M1C alloy), Magnesium (standard, as per AZ-63 or ASTM B843 H.1 alloy grade A), zinc (as per ASTM B-418 type 2), and aluminum (alloy 3 including 0.1% to 0.2% In).

Magnesium anode material may be selected on the following conditions: the pH is greater than 5; the concentration of chloride ions is not considerable; the resistivity of the liquid is above 2000 'Ω–cm; and for potable water tanks magnesium anodes are preferred.

Zinc anode material may be selected on the following conditions: the temperature is less than 50° C.; the concentration of carbonates and bicarbonates is not considerable; and the pH of the liquid is below 9 or concentration of alkalinity is below 800 ppm when sulfate ions do not exist.

Aluminum anode material may be used on the following conditions: chlorides ion concentration is above 1800 ppm; and the temperature is above 50° C. up to 100° C. However, aluminum anodes are not preferred in soil mediums.

The first conically stepped end 12' includes an opening to the female connector 30 having a radius R1, a smaller frustoconical radius R2, a larger fraustoconical radius R3, and an outside radius R4. The long anode segment 12*a* has a cylindrical portion length L1, the frustoconical portions have a length L2, and the isolator 14A has a cylindrical portion length L3. The radius R1 is preferably approximately 0.25 inches, the radius R2 is preferably approximately one inch, the radius R3 is preferably approximately 1.5 inches, and the radius R4 is preferably approximately two inches. The length L1 is preferably approximately 12 inches, the length L2 is preferably approximately one inch, and the length L3 is preferably approximately 0.5 inches. The isolator 14*a* preferably has approximately the same diameter as the long anode segment 12*a* and a conically stepped end matching the end 12". The isolation 14*a* is preferably made from Glass Reinforced Epoxy (GRE) a well known rigid material, and is designed to (1) stabilize connected anode segments, (2) electrically isolate the anode segment ends from the structure being protected, and (3) to prevent the damage of an internal coating due to anode movement, descent, or installation.

The long anode segment 12*a*, which contains the most surface area and is preferred for internal protection of tanks involving aqueous mediums. The long anode segment 12*a* may also be used for external protection of structures in soil mediums as long as the anode assembly is backfilled. A special chemical backfill is often used to surround galvanic anodes placed in a soil environment. To take advantage of the chemical energy stored in a galvanic anode, the electrochemical reaction producing cathodic protection current should occur on the surface of the galvanic anode.

Figure 8B:
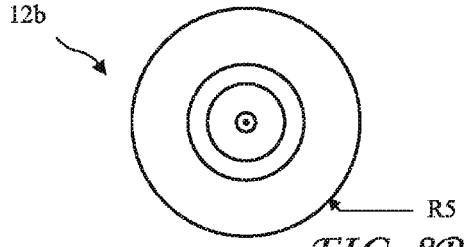
FIG. 8B shows a top view of the medium anode segment according to the present invention.
Figure 8A:
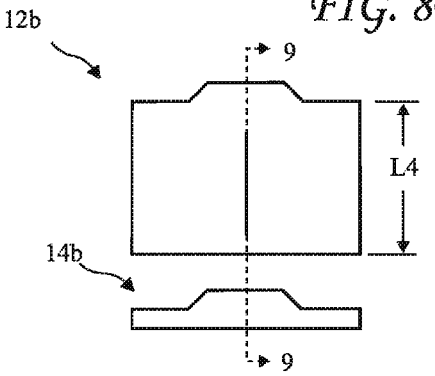
FIG. 8A shows a side view of a medium anode segment according to the present invention.
Figure 9:
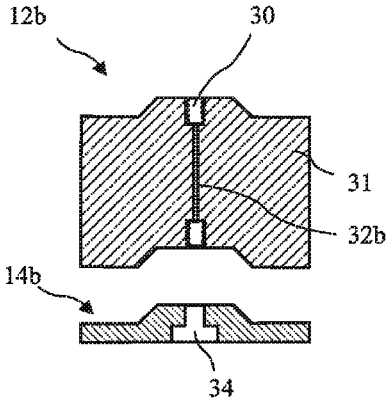
FIG. 9 shows a cross-sectional view of the medium anode segment according to the present invention, taken along line 9-9 of FIG. 8A.

Side views of a medium anode segment 12*b* and an isolator 14*b* are shown in FIG. 8A, a top view of the medium anode segment 12*b* is shown in FIG. 8B, and a cross-sectional view of the medium anode segment 12*b* and isolator 14*b* taken along line 9-9 of FIG. 8A are shown in FIG. 9. The medium anode segment 12*b* and isolator 14*b* have an outside radius R5 and the medium anode segment 12*b* has a cylindrical length L4. The radius R5 is preferably approximately three inches and the length L4 is preferably approximately four inches. The dimensions and construction of the medium anode segment 12*b* and isolator 14*b* are otherwise similar to the long anode segment 12*a* and isolator 14*a*. The medium anode segment 12*b* is designed to best protect against external corrosion of structures in soil mediums but can also be used for internal corrosion protection in tanks and underwater structures involving aqueous mediums.

Figure 10B:
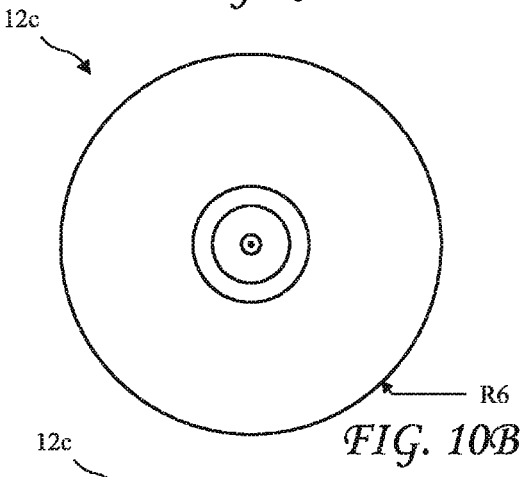
FIG. 10B shows a top view of the short anode segment according to the present invention.
Figure 10A:
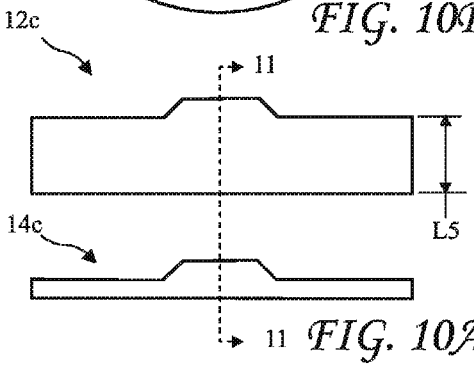
FIG. 10A shows a side view of a short anode segment according to the present invention.
Figure 11:
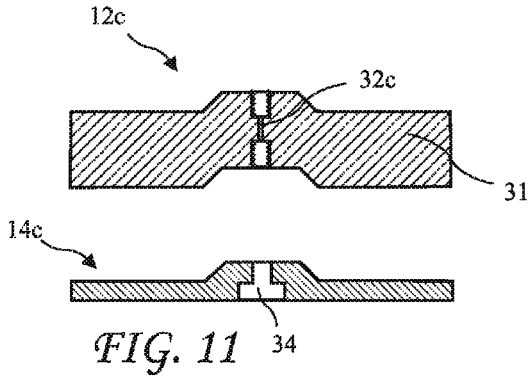
FIG. 11 shows a cross-sectional view of the short anode segment according to the present invention, taken along line 11-11 of FIG. 10A.

Side views of a short anode segment 12*c* and an isolator 14*c* are shown in FIG. 10A, a top view of the short anode segment 12*c* is shown in FIG. 10B, and a cross-sectional view of the short anode segment 12*c* and isolator 14*c* taken along line 11-11 of FIG. 10A are shown in FIG. 11. The short anode segment 12*c* and isolator 14*c* have an outside radius R6 and the short anode segment 12*c* has a cylindrical length L5. The radius R6 is preferably approximately five inches and the length L4 is preferably approximately two inches. The dimensions and construction of the short anode segment 12*c* and isolator 14*c* are otherwise similar to the long anode segment 12*a* and isolator 14*a*. The short anode segment 12*c* is designed to be used in internal protection of tanks and in internal and external protection of hulls and underwater structures. The short anode segment 12*c* are of a larger diameter and shorter height providing a lower profile which reduces effects from high flow velocities inside of tanks or hulls. This short wide design is also useful for cramped areas that cannot accept a long tall anode such as in the internal protection of pipelines. The anodes can be installed on tank bottoms and walls using the long coupling to screw the anode assembly into nuts welded in place at the tank wall or floor.

Figure 12:
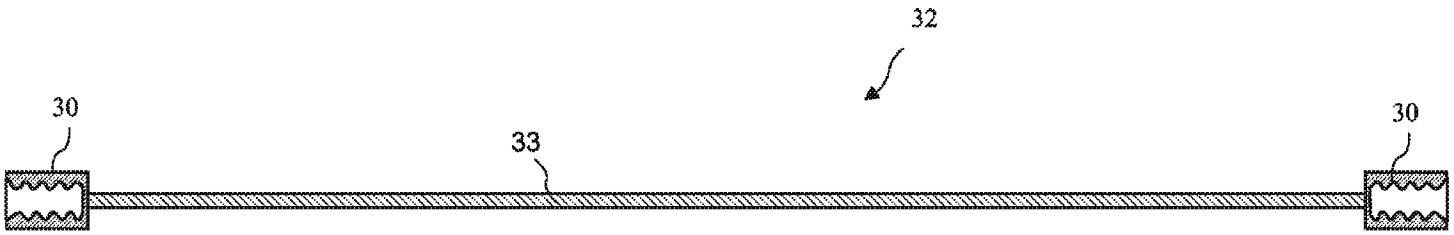
FIG. 12 shows a side view of an anode segment core having female connectors at opposite ends according to the present invention.

A side view of an anode segment core 12 having female connectors 30 at opposite ends is shown in FIG. 12. The anode segment core 12 is electrically conductive. The core 12 is preferably galvanized steel for magnesium anodes and preferably mild steel for both zinc and aluminum anodes. The female connectors 30 may be attached to a single solid shaft 33 of the anode segment core 12, having a smaller diameter than the female connectors 30, in a variety of electrically conductive manners, and are preferably attached to the anode segment core 12 by brazing or welding. The female connectors 30 are preferably approximately 0.5 inches in outside diameter and preferably approximately 0.75 inches in length and has a 0.25 inches by 10 acme female thread.

Figure 13B:
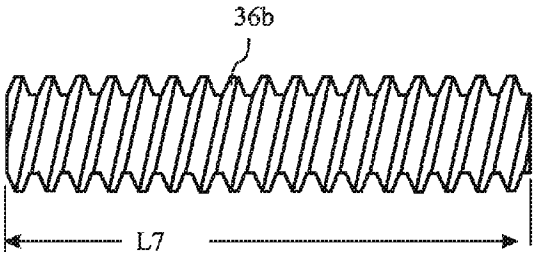
FIG. 13B shows a long male connector according to the present invention.
Figure 13A:
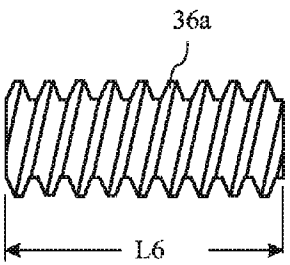
FIG. 13A shown a short male connector according to the present invention.

A short male connector 36*a* is shown in FIG. 13A and a long male connector 36*b* is shown in FIG. 13B. The short male connector 36*a* may be used to connect anode segments, and the long male connector 36*b* may be used to connect the SSAA to a fixed structure. Both connectors 36*a* and 36*b* are electrically conductive. The short male connector 36*a* has a length L6 and the long male connector 36*b* has a length L7. The length L6 is preferably approximately 1.5 inches and the length L7 is preferably approximately 2.25 inches. Both connectors preferably have a 0.25 inches by 10 acme male thread.

The use of the short and long male connectors 36*a* and 36*b* is shown in cross-section in FIG. 14. The short male connector threads into the female connectors of consecutive anode segments to connect the consecutive anode segments. The SSAAs 10*a*, 10*b*, and 10*c* are constructed by threading the small male connectors into each consecutive pair of anode segments 12*a*, 12*b*, and 12*c*. The long male connector 36*b* threads into an end anode segment, passes through an isolator, and extends from the isolator for attachment to a protected structure.

While the invention herein disclosed has been described by means of specific embodiments and applications thereof, numerous modifications and variations could be made thereto by those skilled in the art without departing from the scope of the invention set forth in the claims.

I claim:

1. A Segmented Sacrificial Anode Assembly (SSAA) comprising:

at least two anode segments, each anode segment comprising:

an electrically conductive core;

two electrically conductive threaded female connectors at each end of each anode segment, the connectors electrically connected to the core, and exposed at opposite ends of the anode segment;

a sacrificial material around the core;

a convex end of the sacrificial material; and a concave end of the sacrificial material opposite the convex end and shaped to cooperate with the first end to provide intimate contact between contacting ends; and at least one male connector to connect a concave end of one of the at least two anode segments to a convex end of another of the at least two anode segments;

an isolator at a connectable end of the SSAA, the isolator residing between the SSAA and a protected structure;

a long male connector threaded into the female electrically conductive connector at the connected end of the SSAA and reaching into the isolator; and a portion of the long male connector opposite the SSAA is exposed to allow connection to the protected structure;

a face of the isolator opposite the SSAA includes a recessed volume;

a nut is fixedly attached to a surface of the protected structure;

the SSAA is attached to the nut and no part of the SSAA penetrates the protected structure; and the recessed volume provides a volume for the nut.

2. The SSAA of claim 1, wherein the convex ends and the concave ends are stepped convex ends and stepped concave ends.

3. The SSAA of claim 2, wherein the convex ends and the concave ends are frustoconically stepped convex ends and frustoconically stepped concave ends.

4. The SSAA of claim 1, wherein the sacrificial material is an anode material.

5. The SSAA of claim 1, wherein the electrically conductive core of each segment comprises a solid electrically conductive shaft.

6. The SSAA of claim 5, wherein the solid electrically conductive shaft is smaller diameter than the two electrically conductive threaded female connectors.

7. The SSAA of claim 6, wherein the solid electrically conductive shaft is a shaft made from a material selected from the group consisting of galvanized steel for magnesium anodes and mild steel for both zinc and aluminum anodes.

8. The SSAA of claim 1, further including a lead wire electrically connected to one of the conductive connectors at an end of the SSAA, the lead electrically connectable to a protected structure not structurally connected to the SSAA, wherein the lead wire is connected to the threaded female electrically conductive connectors using a thread male post.

9. The SSAA of claim 8, wherein the structure is distal from the SSAA having no structural connection with the SSAA.

10. The SSAA of claim 8, wherein the lead is connected to the threaded female electrically conductive connectors at the concave end of the anode segment using a thread male post.

11. The SSAA of claim 10, wherein the remaining volume of the concave end of the anode segment is filled with an epoxy after attachment of the lead and threaded male post to the concave end of the anode segment.

12. The SSAA of claim 11, wherein:

the SSAA is buried to protect a buried structure;

the buried structure is distal from the SSAA having no structural connection with the SSAA; and an end of the lead opposite the SSAA is electrically connected to the buried structure.

13. A Segmented Sacrificial Anode Assembly (SSAA) comprising:

at least two anode segments, each anode segment comprising:

an electrically conductive core;

a sacrificial material around the core;

two electrically conductive threaded female connectors at each end of each anode segment, the connectors electrically connected to the core, and exposed at opposite ends of the anode segment;

a frustoconically stepped convex end of the sacrificial material; and a frustoconically stepped concave end of the sacrificial material opposite the frustoconically stepped convex end and shaped to cooperate with the frustoconically stepped convex end to provide intimate contact between adjacent anode segments;

at least one male connector to connect the frustoconically stepped convex end of one of the at least two anode segments to the frustoconically stepped concave end of another of the at least two anode segments;

a lead electrically connected to one of the threaded female connectors at an end of the SSAA, the lead electrically connectable to a buried structure; and a nut is fixedly attached to a surface of the protected structure;

the SSAA is attached to the nut and no part of the SSAA penetrates the protected structure.

14. The SSAA of claim 13, wherein the buried structure is distal from the SSAA having no structural connection with the SSAA.

15. The SSAA of claim 13, wherein:

a nut is fixedly attached to a surface of the protected structure;

the SSAA is attached to the nut and no part of the SSAA penetrates the protected structure.

16. A Segmented Sacrificial Anode Assembly (SSAA) comprising:

at least two anode segments, each anode segment comprising:

an electrically conductive core;

two electrically conductive threaded female connectors at each end of each anode segment, the connectors electrically connected to the core, and exposed at opposite ends of the anode segment;

a sacrificial material around the core;

a frustoconically stepped convex end of the sacrificial material; and a frustoconically stepped concave end of the sacrificial material opposite the frustoconically stepped convex end and shaped to cooperate with the frustoconically stepped convex end to provide intimate contact between adjacent anode segments;

at least one male connector to connect the frustoconically stepped convex end of one of the at least two anode segments to the frustoconically stepped concave end of another of the at least two anode segments;

an isolator at a connectable end of the SSAA;

a face of the isolator opposite the SSAA including a recessed volume, the recessed volume providing a volume for a nut fixedly attached to a protected structure;

a long male connector threaded into the female electrically conductive connector at the connectable end of the SSAA and reaching into the isolator; and a portion of the long male connector opposite the SSAA having exposed threads to allow connection to a protected structure.

17. The SSAA of claim 16, wherein:

the nut is fixedly attached to a surface of the protected structure;

the isolator is constructed of an electrically insulating material and resides between the SSAA and the protected structure;

the SSAA is attached to the nut by the long male connector reaching through the isolator;

no part of the nut penetrates the protected structure;

no part of the long male connector penetrates the protected structure;

no part of the isolator penetrates the protected structure; and no part of the SSAA penetrates the protected structure.

18. The SSAA of claim 17, wherein the nut is fixedly attached to an exterior surface of the protected structure.

19. A Segmented Sacrificial Anode Assembly (SSAA) comprising:

at least two anode segments, each anode segment comprising:

an electrically conductive core;

two electrically conductive threaded female connectors at each end of each anode segment, the connectors electrically connected to the core, and exposed at opposite ends of the anode segment;

a sacrificial material around the core;

a convex end of the sacrificial material; and a concave end of the sacrificial material opposite the convex end and shaped to cooperate with the first end to provide intimate contact between contacting ends; and at least one male connector to connect a concave end of one of the at least two anode segments to a convex end of another of the at least two anode segments;

an isolator made of an electrically insulating material at a connectable end of the SSAA, the isolator residing between the SSAA and a protected structure;

a long male connector threaded into the female electrically conductive connector at the connected end of the SSAA and reaching into the isolator; and a portion of the long male connector opposite the SSAA is exposed to allow connection to the protected structure.

20. The SSAA of claim 19, wherein the isolator is made of a rigid electrically insulating material.

21. A Segmented Sacrificial Anode Assembly (SSAA) comprising:

at least two anode segments, each anode segment comprising:

an electrically conductive core;

two electrically conductive threaded female connectors at each end of each anode segment, the connectors electrically connected to the core, and exposed at opposite ends of the anode segment;

a sacrificial material around the core;

a convex end of the sacrificial material; and a concave end of the sacrificial material opposite the convex end and shaped to cooperate with the first end to provide intimate contact between contacting ends; and at least one male connector to connect a concave end of one of the at least two anode segments to a convex end of another of the at least two anode segments, wherein:

a mount is fixedly attached to a surface of a protected structure, the mount including a nut and a threaded male connector;

the SSAA is attached to the male threaded portion;

an isolator constructed of an electrically insulating material residing between the SSAA and the protected structure;

no part of the isolator penetrates the protected structure;

no part of the mount penetrates the protected structure; and no part of the SSAA penetrates the protected structure.

* * * * *